US006910477B1

(12) United States Patent
Barber

(10) Patent No.: US 6,910,477 B1
(45) Date of Patent: Jun. 28, 2005

(54) WALL MOUNTED VENTED HEATER

(75) Inventor: Nicholas Andrew Barber, Maple Ridge (CA)

(73) Assignee: Off The Wall Fires, Inc., British Columbia (CA)

( * ) Notice: Subject to any disclaimer, the term of this patent is extended or adjusted under 35 U.S.C. 154(b) by 0 days.

(21) Appl. No.: 10/753,381

(22) Filed: Jan. 9, 2004

(51) Int. Cl.[7] ..... F24C 3/00
(52) U.S. Cl. ..... 126/91 R; 126/503
(58) Field of Search ..... 126/85 R, 91 R, 126/85 B, 503, 116 B

(56) References Cited

U.S. PATENT DOCUMENTS 2,632,435 A * 3/1953 Lundstrum ..... 126/90 R
2,846,997 A * 8/1958 Reeves et al. ..... 126/116 B
3,017,878 A * 1/1962 Cayot ..... 126/116 B
3,171,402 A * 3/1965 Carlson ..... 126/116 R
3,258,004 A * 6/1966 Bedell et al. ..... 126/110 R
3,623,470 A * 11/1971 Wilhoite ..... 126/503
3,662,735 A * 5/1972 Jackson ..... 126/85 B

FOREIGN PATENT DOCUMENTS

FR 2 638 820 * 5/1990 ..... F24H 1/28

* cited by examiner

*Primary Examiner*—Stephen Gravini
(74) *Attorney, Agent, or Firm*—Ogilvy Renault LLP; Paul J. Field

(57) ABSTRACT

The invention relates to a gas fired vented heater preferably having a relatively thin profile adapted for mounting on or in a wall structure and having a heat radiant display surface with visible decorative refractory defining a rear wall of the combustion chamber.

15 Claims, 7 Drawing Sheets

WALL MOUNTED VENTED HEATER

TECHNICAL FIELD

The invention relates to a gas fired vented heater preferably having a relatively thin profile adapted for mounting on or in a wall structure and having a heat radiant display surface with visible decorative refractory defining a rear wall of the combustion chamber.

BACKGROUND OF THE ART

The prior art of relevance includes gas fired fireplaces and radiant heaters which usually include a gas fired burner housed within a sheet metal enclosure lined with refractory or other heat resistant material to form a combustion chamber that intakes combustion air, exhausts combustion products through a flue and emits radiant heat through a front surface and possibly lateral or top surfaces as well.

Conventional wood burning fireplaces or stoves have the disadvantages of being a fire hazard and creating dust and ash waste which prior art gas fired appliances do not. However, converting an existing fireplace to receive a gas fired fireplace uses the existing chimney or flue, and is of limited application as a result. Stand alone gas fired fireplace appliances relieve this requirement but remain positioned on a floor surface requiring the protection of the floor surface with a stone, ceramic or metal apron. Gas fired unit heaters are used extensively to heat construction areas, barns, tents or other shelters usually on a temporary basis. Use of such heaters in homes, restaurants or commercial buildings is a limited application due to the risk of accidental contact, personal injury or fire.

The invention is directed to a novel gas fired vented heater adapted for mounting on or in a wall structure, that has a relatively thin profile to fit inside the wall with a display surface visible to the inside of the room, or directly hung on the wall like a flat screen television or artistic work for example. The positioning of the vented heater at a distance above the floor surface creates a novel visual effect closer to eye level, and in addition eliminates the need to protect the floor surface from heat exposure while placing the hot surfaces away from small children, pets and avoids other risks of accidental contact.

Further features of the invention will be apparent from review of the disclosure, drawings and description of the invention below.

DISCLOSURE OF THE INVENTION

The invention provides a gas fired vented heater preferably having a relatively thin profile adapted for mounting on or in a wall structure and having a heat radiant display surface with visible decorative refractory defining a rear wall of the combustion chamber.

Specifically the vented heater has an enclosure adapted for wall mounting with a front display surface, an interior chamber accessible through an access opening with a removable cover, an air inlet and exhaust outlet. A removable heat insulating liner is disposed within the interior chamber having a display opening aligned with the display surface of the enclosure, a lower air intake and an upper exhaust opening in communication with the exhaust outlet. A fuel burner within the liner has a fuel inlet, an igniter and a flame outlet.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
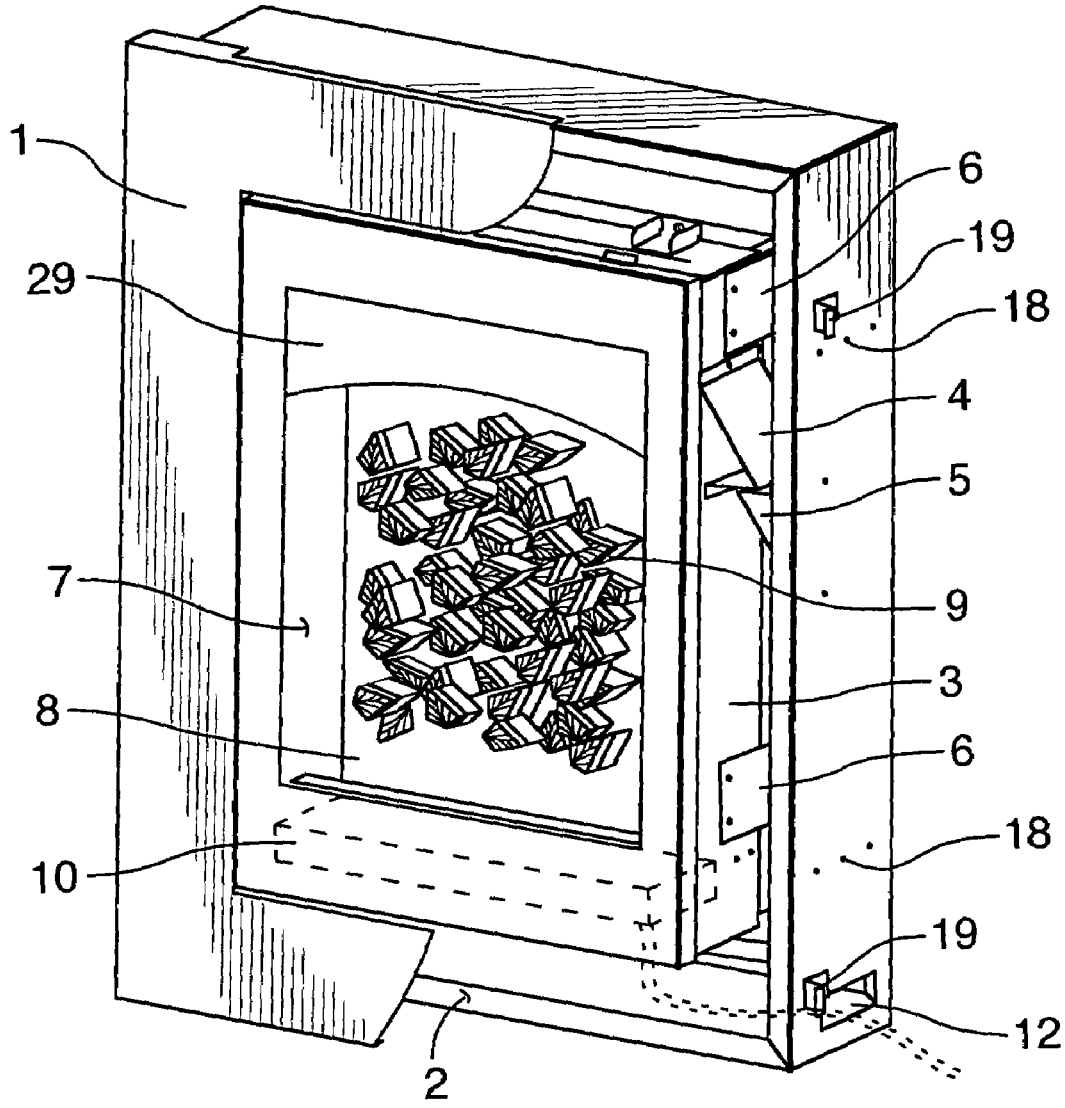
FIG. 1 is a front perspective view of the assembled exterior shell with removable enclosure installed therein, having the front trim frame partially broken away to reveal the enclosure supporting brackets.

FIG. 1 shows an assembled vented heater with external trim frame 1 partially broken away to reveal the external shell 2 that is mounted within a wall structure and supporting an enclosure 3 on support mounts or brackets 4, 5, 6 within.

The trim frame 1 surrounds a display cover 7 with a central window revealing the combustion chamber 8. The back wall of the heat resistant insulating liner includes a visually appealing array of forwardly protruding relief portions 9 defining flame directing channels there-between. The flames emitted from the gas fired burner 10 may be in the form of a narrow sheet extending upwardly and flowing through these flame directing channels. The protrusions 9 and liner (best seen in FIGS. 7–8) may be of refractory or compressed vermiculite and after contact with the flames and heat of the combustion chamber, may glow emitting visible light in the yellow, orange and red spectrum, resulting in a pleasing pattern of flame and glowing light together with radiant heat through the display cover window surface.

Figure 2:
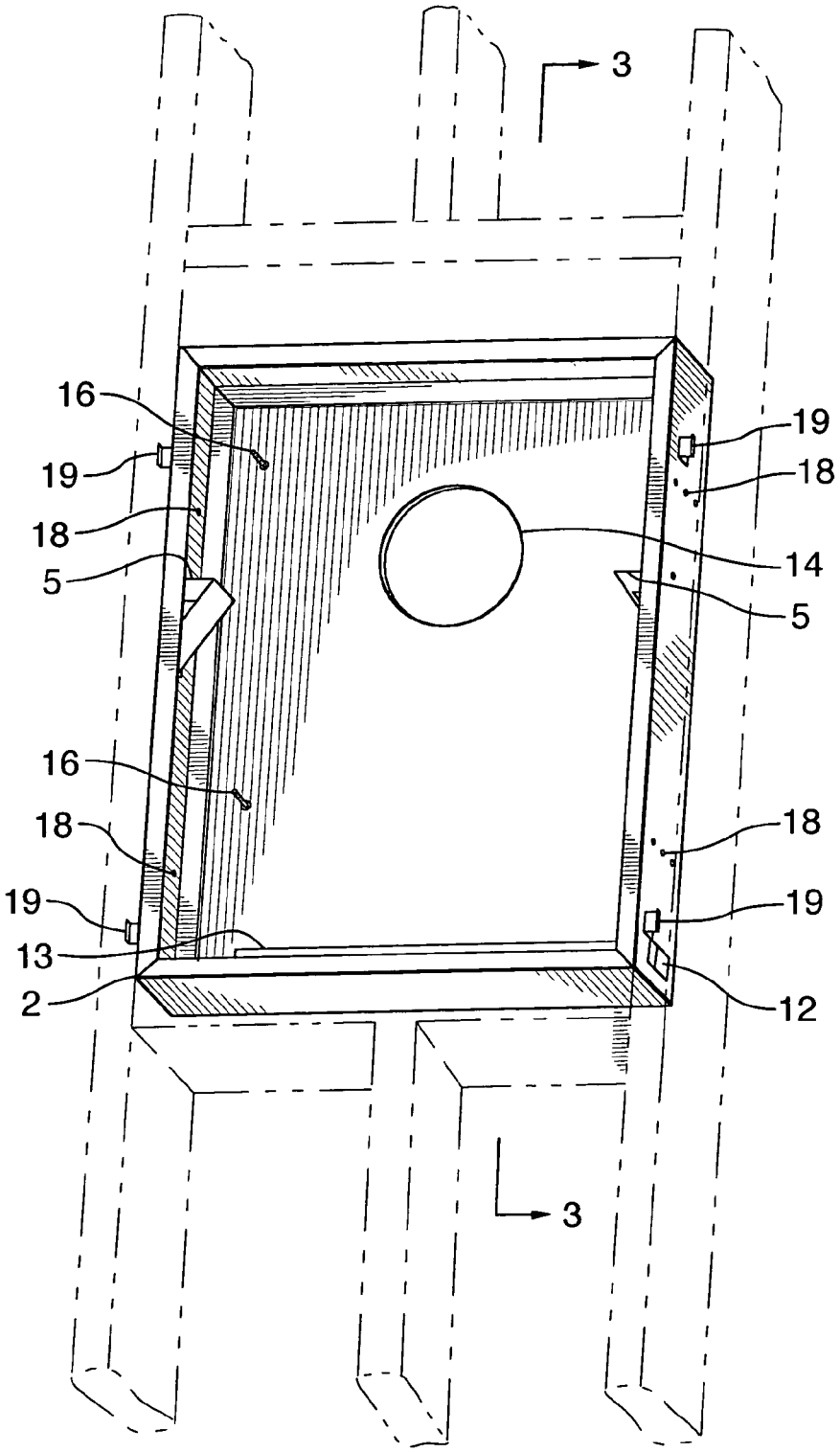
FIG. 2 is a front perspective view of the exterior shell that is mounted in a framed opening in a wall structure, with inner side mounting brackets to support the removable enclosure.
Figure 3:
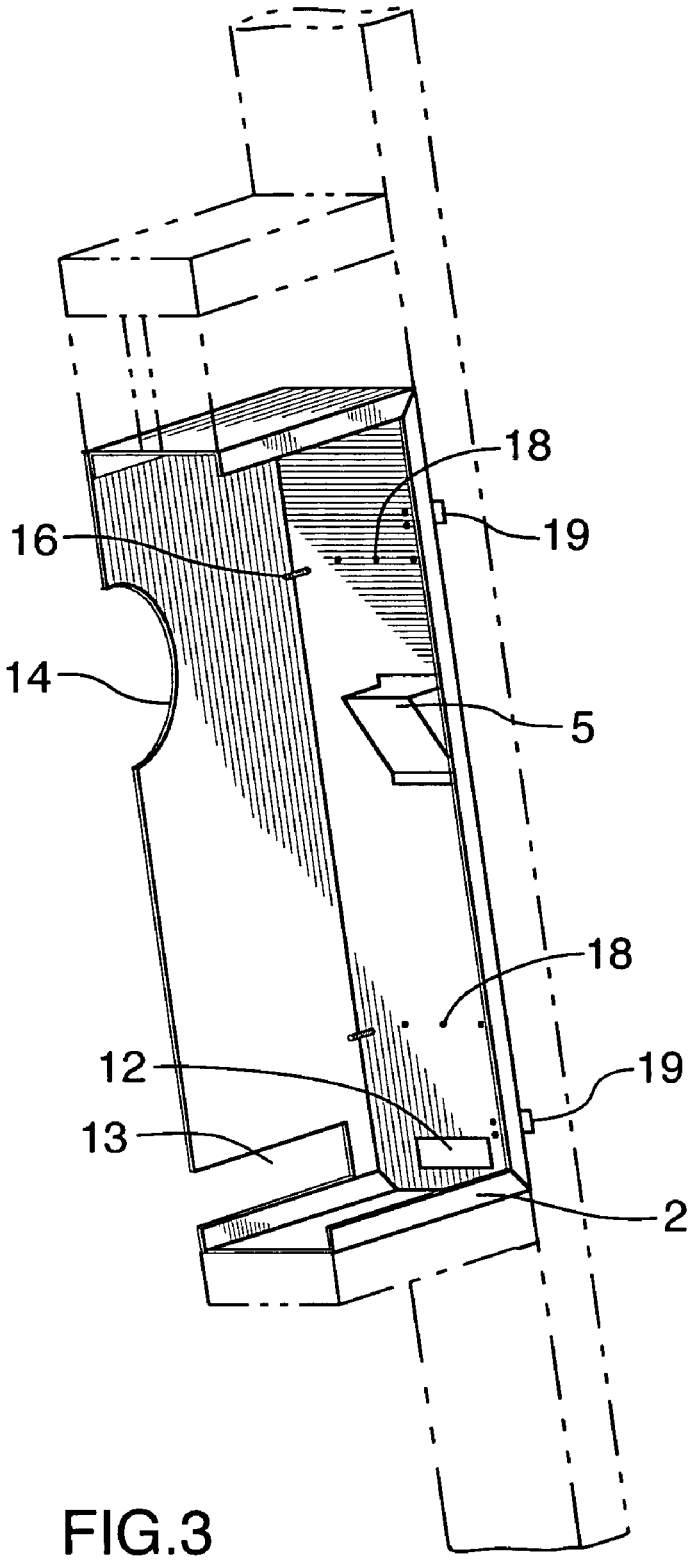
FIG. 3 is a sectional perspective view along line 3—3 of FIG. 2 showing the interior structure of the exterior shell.

The enclosure 3 is adapted for wall mounting within an exterior shell 2 for example, as indicated in FIGS. 1–3. The exterior shell 2 may be of sheet metal, preferably corrosion resistant stainless steel or galvanized steel. The shell 2 provides an air gap between the enclosure 3 and any wall structure such as a wooden stud 11 framed exterior wall as shown in phantom outline in FIGS. 2–3. In the embodiment shown, the vented heater assembly is installed in an exterior wooden stud wall. However it will be apparent to those skilled in the art that the vented heater can be installed in an internal wall with appropriate air intake and combustion gas flue ducting, or in a masonry wall for example.

Figure 4:
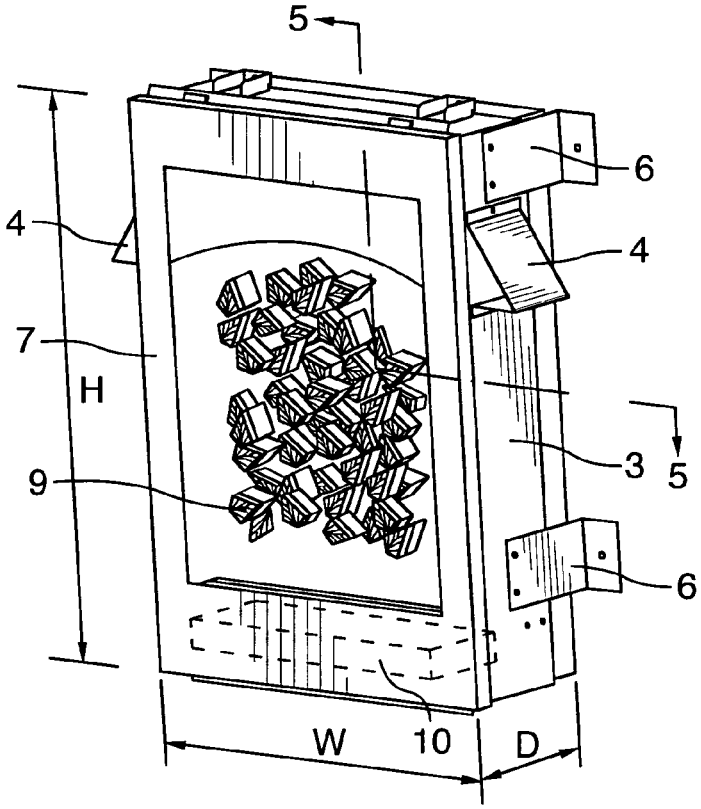
FIG. 4 is a front perspective view of the enclosure with display surface revealing the internal liner of the combustion chamber and the gas fired burner in a lower portion.

The exterior shell 2 includes openings 12, 13 in side and back walls for roughing in electrical supply and gas supply conduits to the gas fired burner 10 (shown in FIGS. 1, 4). A port 14 enables positioning of a hole in the wall structure for a direct vented air inlet about a gas exhaust duct 15 (see FIG. 5). Support mounts 5 extend inwardly to engage mating support mounts 4 extending outwardly from the enclosure 3 as indicated in the assembled view of FIG. 1. Further support is provided by four threaded studs 16 that extend through holes 17 in four rearwardly extending mounts 6 of the enclosure (see FIG. 4). The exterior shell 2 is secured to the wooden studs 11 by lateral holes 18 in the side walls for screws. The four tabs 19 provide a laterally extending guide surface to align the shell 2 at the appropriate depth into the wall, and as well include forwardly extending clips upon which the rear inside surface of the trim frame 1 can be mounted (see FIG. 1 for example).

Figure 5:
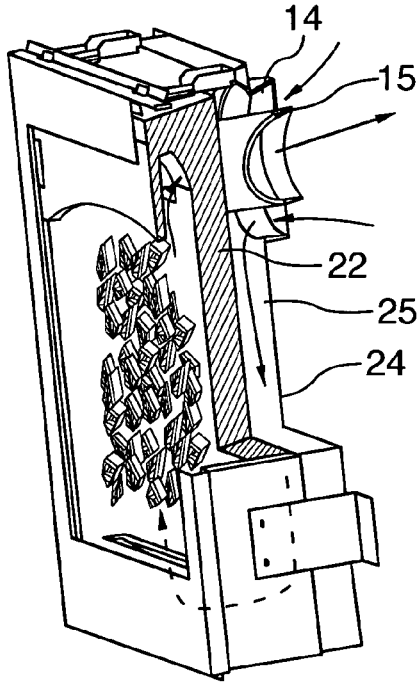
FIG. 5 is a sectional perspective view along line 5—5 of FIG. 4.
Figure 6:
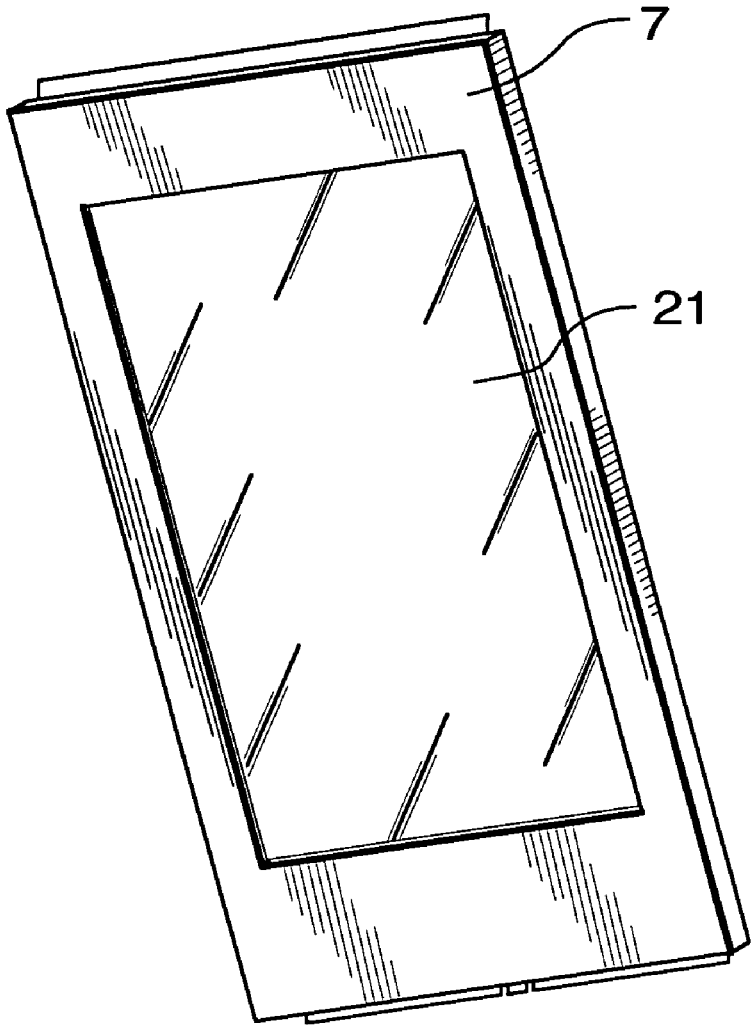
FIG. 6 is a front perspective view of the access and display cover with a central viewing window.

The components of the enclosure 3 are best seen in FIGS. 4–5. The enclosure 3 itself has a front display surface 20, with an interior chamber accessible through a front access opening with a removable display cover 7 with a central window 21, an air inlet through port 14 and exhaust outlet duct 15. The removable heat insulating liner 22 (best seen in FIGS. 7–8) is housed within the interior chamber of the enclosure and has a front display opening aligned with the display surface of the enclosure 3. The liner 22 is upwardly spaced from the bottom of the enclosure to define a lower air intake into the liner combustion chamber and an upper exhaust opening 23 in communication with the exhaust outlet duct 15. The fuel burner 10 within the liner 22 has a fuel inlet conduit fed through openings 12 or 13, an integral igniter (not shown) and a flame outlet slit in the top surface to emit a sheet of flame.

To adapt the enclosure for flat wall mounting on or in a wall structure, the enclosure 3 may have a height "H", a width "W" and a depth "D", the depth D being less than 25% and optionally 15% of one of the width W or the height H. The depth D may be as little as 3–6 inches or less for example.

As seen in FIG. 5, the liner 22 is disposed forwardly of a rear wall 24 of the enclosure 3 defining an air flow plenum 25 between the air inlet port 14 of the enclosure 3 and the lower air intake of the liner 22. The liner 22 may be slidably removable from the enclosure 3 via the front access opening by removing the display cover 7. As a result, a user can change the appearance of the liner 22 readily.

Figure 7:
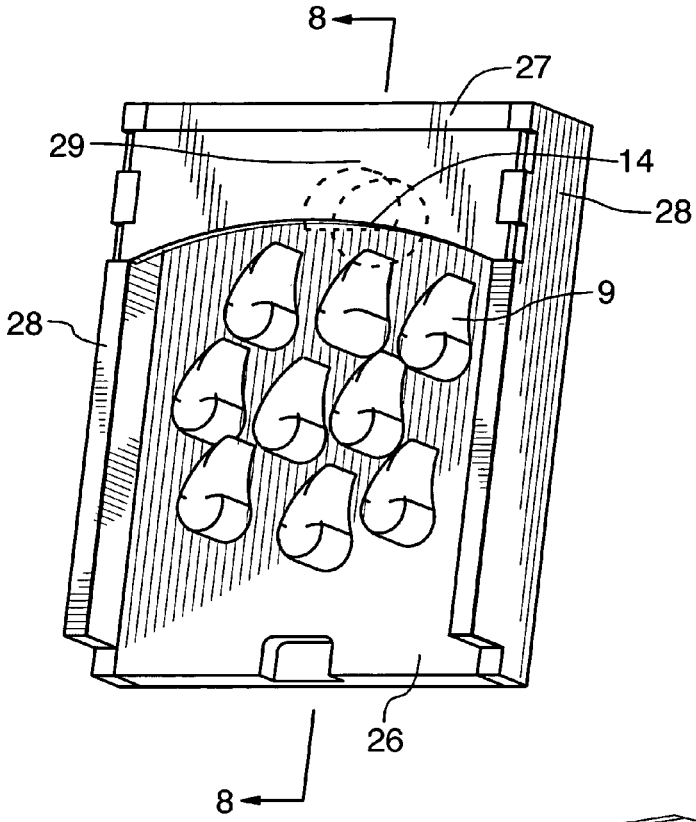
FIG. 7 is a front perspective view of the removable heat insulating liner with rear wall including teardrop shaped protrusions, two side walls and a front wall defining a combustion chamber with an upper exhaust opening.
Figure 8:
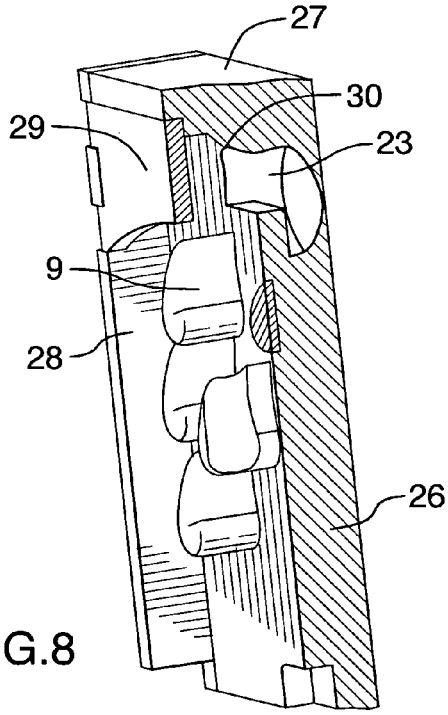
FIG. 8 is a sectional perspective view along line 7—7 of FIG. 6.
Figure 9:
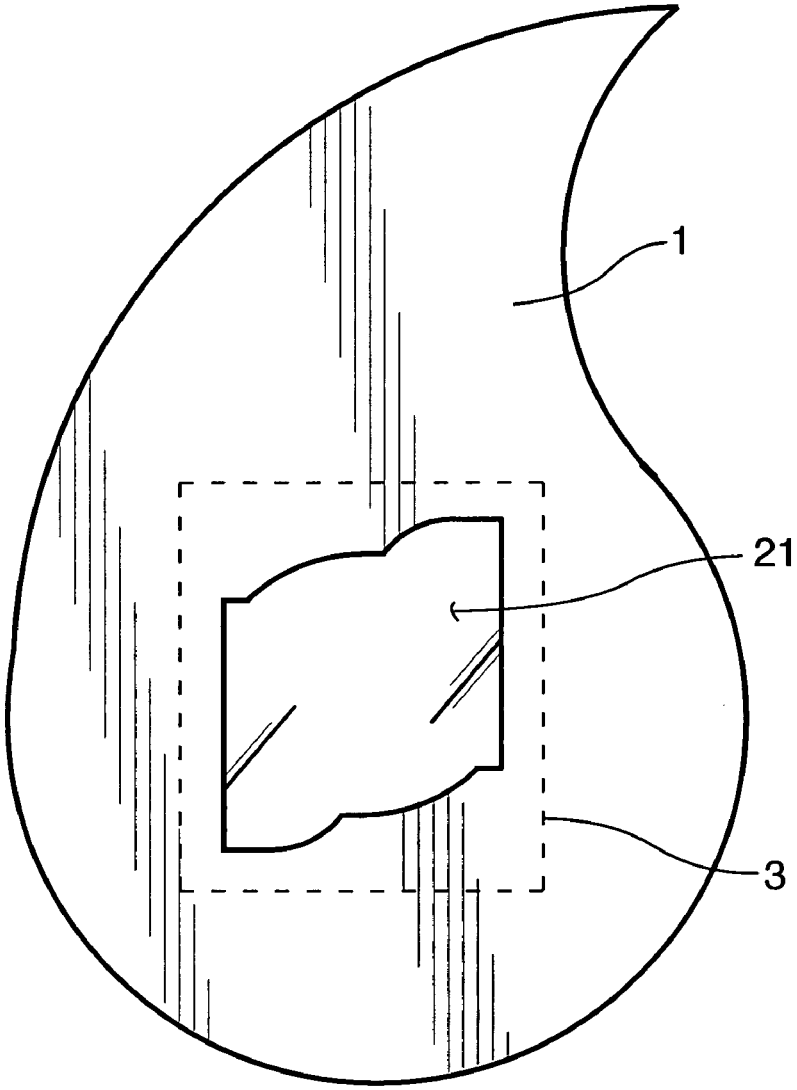
FIG. 9 is a front elevation view of an optional front trim frame in a teardrop shape with rectangular opening to reveal the display surface of the enclosure.

As seen in FIGS. 7–8, the liner 22 has a back wall 26, a top wall 27 and side walls 28 defining a forward facing combustion chamber. The liner 22 may also have a front exhaust gas containment wall 29 above the display opening with a curved inner surface 30 of the top wall 27 to direct the flow of exhaust gases to the exhaust opening 23.

To add visual appeal and enhance the heat radiating capacity of the liner 22 the back wall 26 of the liner includes one or more forwardly protruding relief portions 9 defining flame directing channels there-between.

Although the above description relates to a specific preferred embodiment as presently contemplated by the inventor, it will be understood that the invention in its broad aspect includes mechanical and functional equivalents of the elements described herein.

I claim:

1. A vented heater comprising:

an enclosure adapted for wall mounting having a front display surface, an interior chamber accessible through an access opening with a removable cover, an air inlet and exhaust outlet;

a removable heat insulating liner within the interior chamber having a display opening aligned with the display surface of the enclosure, a lower air intake and an upper exhaust opening in communication with the exhaust outlet; and a fuel burner within the liner having a fuel inlet, an igniter and a flame outlet.

2. The vented heater according to claim 1 wherein the liner is disposed forwardly of a rear wall of the enclosure defining an air flow plenum between the air inlet of the enclosure and the lower air intake of the liner.

3. The vented heater according to claim 1 wherein the liner is removable from the enclosure via the access opening.

4. The vented heater according to claim 1 wherein the liner has a back wall, a top wall and side walls defining a combustion chamber.

5. The vented heater according to claim 4 wherein the liner has a front exhaust gas containment wall above the display opening.

6. The vented heater according to claim 4 wherein the back wall of the liner includes at least one forwardly protruding relief portion.

7. The vented heater according to claim 6 wherein the back wall includes a plurality of forwardly protruding relief portions defining flame directing channels there-between.

8. The vented heater according to claim 1 wherein the access cover comprises a display cover removably mounted over the display opening.

9. The vented heater according to claim 8 further comprising a trim frame removably mounted over the display cover.

10. The vented heater according to claim 1 further comprising an exterior shell disposed about the enclosure, the shell having an open front through which the enclosure can be removed.

11. The vented heater according to claim 10 wherein the shell and enclosure include releasable mounts.

12. The vented heater according to claim 11 wherein the mounts comprise protruding support brackets.

13. The vented heater according to claim 11 wherein the mounts comprise threaded studs.

14. The vented heater according to claim 1 wherein the enclosure has a height, a width and a depth, the depth being less than 25% of one of the width and the height.

15. The vented heater according to claim 14 wherein the depth being less than 15% of one of the width and the height.

* * * * *